United States Patent [19]

Deves

[11] Patent Number: 4,562,519

[45] Date of Patent: Dec. 31, 1985

[54] HEADLAMP FOR AN AUTOMOBILE

[75] Inventor: Patrick Deves, Saint Maur, France

[73] Assignee: Cibie Projecteurs, Bobigny, France

[21] Appl. No.: 636,321

[22] Filed: Jul. 31, 1984

[30] Foreign Application Priority Data

Aug. 18, 1983 [FR] France ..... 83 13442

[51] Int. Cl.[4] ..... F21V 13/00

[52] U.S. Cl. ..... 362/308; 362/328; 362/331; 362/343

[58] Field of Search ..... 362/308, 309, 328, 331, 362/336, 343, 268

[56] References Cited

U.S. PATENT DOCUMENTS

| | | | |
|---|---|---|---|
| 1,539,090 | 5/1925 | King | 362/308 |
| 3,578,966 | 5/1971 | Levin | 362/309 |
| 3,598,989 | 8/1971 | Biggs | 362/308 |
| 3,999,056 | 12/1976 | Faulhaber | 362/268 |
| 4,100,594 | 7/1978 | Gould | 362/308 |

FOREIGN PATENT DOCUMENTS

| | | | |
|---|---|---|---|
| 2636137 | 2/1978 | Fed. Rep. of Germany . | |
| 2138152 | 4/1983 | Fed. Rep. of Germany . | |
| 710340 | 8/1931 | France | 362/308 |

*Primary Examiner*—Andrew M. Dolinar

*Attorney, Agent, or Firm*—McCormick, Paulding & Huber

[57] ABSTRACT

A headlamp for an automobile, capable of emitting a beam of light with a cut-off comprising an elliptical reflector having two focii, a light source at the first focus of the reflector, and a convergent lens located opposite the reflector with respect to the second focus. The lens and the reflector have a common optical axis and the focus of the lens is at the second focus of the reflector. A screen is located at the common focus having an edge close to the optical axis in order to define the cut-off beam. Localized deflector elements are provided at the upper part and the lower part of the lens to produce a lateral dispersion and/or a lowering of the light passing through these parts of the lens in order to reduce the effects of the chromatic aberrations in the vicinity of the cut-off.

10 Claims, 3 Drawing Figures

HEADLAMP FOR AN AUTOMOBILE

BACKGROUND OF THE INVENTION

The present invention relates to a headlamp capable of emitting a beam of light with a cut-off in order to form a dipped headlamp of the type known as the "standard European beam" or a fog lamp for an automobile. Thus the term "headlamp" as used herein includes those lamps known as "fog lamps".

It has been proposed to reduce the bulk of such headlamps while maintaining an equal emission of flux by employing a construction incorporating an ellipsoidal reflector having two focii, a light source at one focus and a lens beyond the other focus so that the focus of the lens coincides with the other reflector focus. A masking screen is located at the common focus to produce a cut-off beam.

Such a construction is described for example by French Pat. No. 82.20200 in the name of the present applicants.

In order to obtain a good photometric performance with such headlamps it is necessary to use a lens having a large aperture, that is to say a considerable ratio of its transverse dimensions with respect to the optical axis to its focal length, in order to pick up all the flux emitted by the reflector. However, this aperture involves significant chromatic aberrations.

These chromatic aberrations result from a difference in deflection in the plane of incidence of the different elementary colours constituting one single ray which has just struck the lens, and tend to be more significant as the light rays are deflected more, that is to say those rays deflected by the peripheral zones of the lens. These aberrations can be corrected in the same way as in photographic optics, by substituting the convergent lens by a group of juxtaposed lenses in which the respective chromatic aberrations balance each other. However, this solution is complex and costly, and an object of the present invention is to propose a similar solution, specifically adapted to the particular context of headlamps with a cut-off beam for automobiles.

Bearing in mind that the orientation of the cut-off in the case of a fog lamp for automobiles is horizontal or additionally slightly inclined with respect to the horizontal for a headlamp, these aberrations tend not to be troublesome when they are caused by the lateral zones of the lens, i.e. the zones which do not cause deflection at too great an inclination with respect to the horizontal. On the other hand, the upper and lower parts of the lens tend to cause iridescence which result in unacceptable imprecision and colouring at the cut-off of the beam.

SUMMARY OF THE INVENTION

It is an object of the present invention to provide a headlamp construction which minimises or avoids these iridescences. As stated above it is a further object that the construction be as simple as possible.

According to the invention, there is provided a headlamp for an automobile, capable of emitting a beam of light with a cut-off, said headlamps comprising a part-ellipsoidal reflector having an optical axis, a first focus relatively close to said reflector and a second focus relatively distant from said reflector, a light source located in the vicinity of said first focus of said reflector, a convergent lens arranged opposite said reflector with respect to said second focus of said reflector, said lens having an optical axis merged with that of said reflector and a focus in the vicinity of said second focus of said reflector, a masking screen arranged in the vicinity of said focus of said lens and having an edge close to the common optical axis in order to define a cut-off beam, and localised deflector elements in the vicinity of said lens at its upper part and at its lower part to produce a deflection of the light passing through said upper and lower parts of said lens in order to reduce the effects of chromatic aberrations in the vicinity of said cut-off.

Thus, in order to remedy the drawbacks of the known constructions, the invention provides for this iridescence to merge into the rest of the beam by providing the localised deflector elements. These produce a lateral dispersion and/or a lowering of the light passing through the corresponding parts of the lens. The deflector elements can be directly integral with the lens, preferably in the form of elements joined onto the lens. Alternatively they can be integral with a transparent glass adjacent the lens. They can also be located before the lens in order to create a diffusion of the light rays which attenuates the effect of the aberrations.

Experiments have shown that in this way it is possible to obtain a satisfactory correction of the chromatic aberrations when an image is observed on a screen placed at 25 mm from the headlamp in accordance with regulations currently in force in Europe. Preferably, the upper and lower parts of the lens provided with the deflector elements comprise bands which are contiguous respectively with the upper and the lower edge of the lens, each of these bands having a height between 1/10 and $\frac{1}{4}$ of the height of the lens.

Other characteristics and advantages of the invention are set out in the description below relating to a non-limiting mode of construction and in the drawings which form an integral part of this description.

DESCRIPTION OF THE PREFERRED EMBODIMENTS

Figure 1:
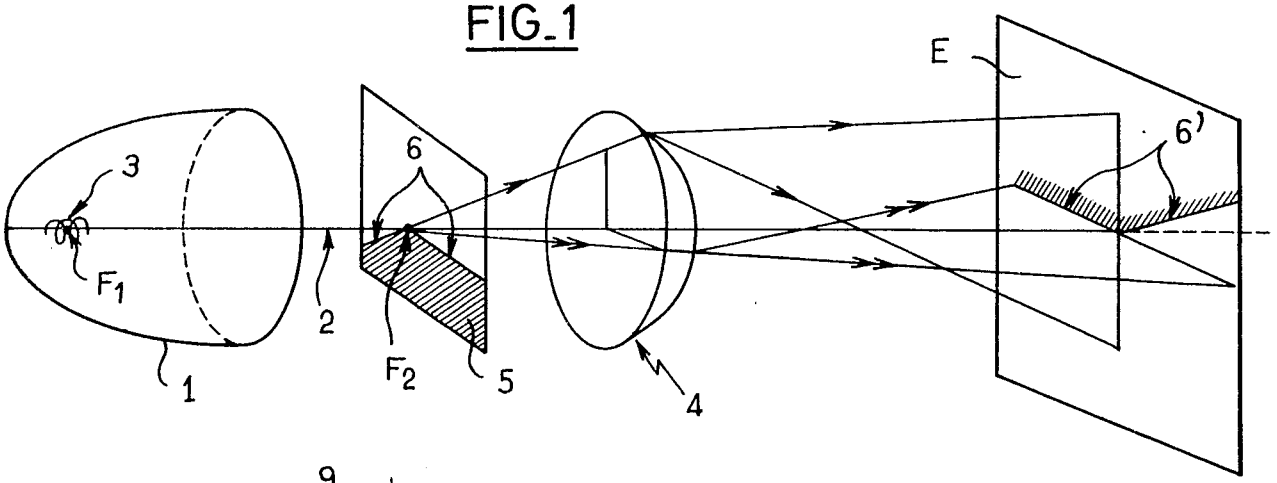
FIG. 1 shows schematically the construction of a conventional headlamp incorporating an elliptical reflector, a masking screen and a lens, arranged to produce a cut-off beam.

The conventional construction shown in FIG. 1 comprises an elliptical reflector 1 having an optical axis 2 and two foci F1 close to the base of the reflector 1 and F2 further away. A light source 3, in this case a filament is located in the vicinity of the first focus F1. The light rays emitted by the light source 3 are reflected by the reflector 1 in the direction of the second focus F2.

A convergent lens 4 is arranged opposite the reflector 1 with respect to the focus F2. The axis of the lens 4 is in common with the axis 2 of the reflector 4 and the focus of the lens 4 is in the vicinity of F2. Thus light rays emitted by the light source 3 are reflected by the reflector 1, converge in the vicinity of F2, and are picked up by the lens 4 which forms a useful beam.

In order for the beam to be a cut-off beam, a masking screen 5 is arranged in the vicinity of the focus F2. This screen 5 has an upper edge 6 defining the limit of the cut-off of the beam. In the example shown in FIG. 1, the screen 5 is shown flat, perpendicular to the axis 2, and the cut-off edge is formed by two lines extending from the optical axis. On a screen E placed at 25 meters from the headlamp in accordance with the standards currently in force—it will be seen that a cut-off limit 6' corresponding to the edge 6 is shown on the screen E.

In order to obtain a good photometric performance with a conventional system of this type as shown in FIG. 1, it is preferable to use a lens having an aperture (ratio of its diameter to its focal distance) which is relatively large in order to collect all the flux emitted by the elliptical reflector. However, this results in chromatic aberrations which cause iridescence of the cut-off on the screen E. Thus, the edge 6' forming the cut-off limit becomes iridescent and such chromatic aberrations become all the more significant with the light rays which are deflected more, i.e., those closer to the periphery of the lens.

Therefore, breakup of the light occurs, with the blue light being deflected more than the red light when passing through the lens.

A careful study of the phenomenon has shown that when these chromatic aberrations are produced in the zones on the left and on the right of the lens they are not particularly troublesome as regards the appearance of the cut-off because the differential deflections of the different lights in these zones are essentially deflections in the horizontal direction, just like the usual cut-off limits (for a dipped beam the cut-off is formed by a horizontal half-plane and a half-plane which is slightly raised, as shown at 6'; for a fog lamp beam the cut-off is straight and horizontal). As a result the iridescences merge into the beam of useful light without exceeding the cut-off limit in any significant way.

On the other hand, the zones at the top and at the bottom of the lens cause differential deflections in the vertical direction. This results in iridescences which overlap the cut-off limit and which are perfectly visible, and so definitely interfere with the distinctness of the cut-off.

FIG. 2 shows the zones 7 and 8 at the upper and lower portions of the lens, for which the chromatic aberrations cause a significant iridescence at the cut-off limit 6'. In order to remedy this effect, localised deflector elements 9 and 10 are arranged in these zones, producing a lowering and/or a lateral dispersion of the light. If the light is lowered, in effect, the iridescences pass below the cut-off limits. If reliefs are used to produce an effect of lateral dispersion or of diffusion, the effect of the chromatic aberrations at the level of the cut-off is greatly reduced.

Figure 2A:
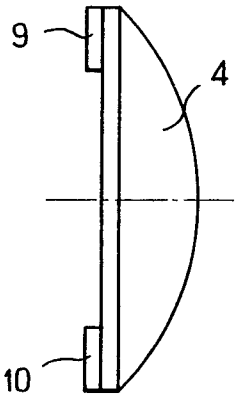
FIGS. 2*a* and 2*b* show a side view and a rear view respectively of a lens from a headlamp in accordance with the invention.
Figure 2B:
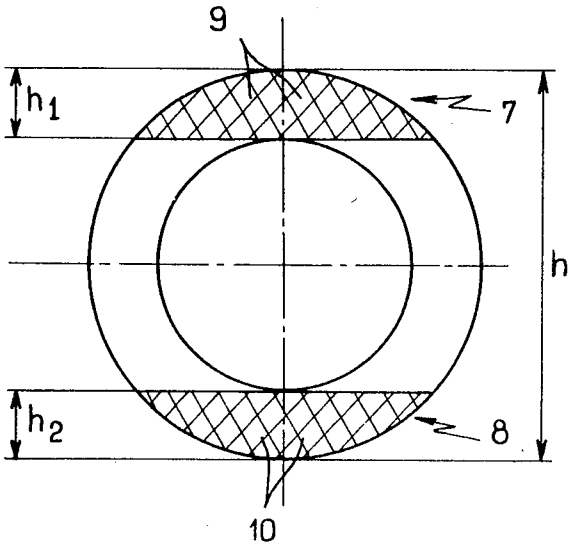

The deflector elements 9, 10 can be integral with the lens (as shown in FIGS. 2*a* and 2*b*) or with a transparent glass adjacent the lens. As a general rule such deflector elements 9, 10 can be arranged at any position along the path of the rays, after the screen 5. In fact, if the chromatic aberrations only occur at the lens 4, a diffusion or a dispersion of the light rays before the lens always attenuates the effect of the chromatic aberrations at the cut-off.

The precise nature of the deflector elements to be used can be determined for each particular case. Generally, however, the deflector elements are preferably distributed in bands contiguous respectively with the upper edge and the lower edge of the lens 4, as shown in FIG. 2*b*. Advantageously the heights h1 and h2 of these bands are between 1/10 and ¼ of the height h of the lens 4 itself.

Obviously, numerous modifications and variations of the present invention are possible in the light of the above teachings. It is therefore to be understood that within the scope of the appended claims, the invention may be practiced otherwise than as speficially described herein.

What is claimed as new and desired to be secured by Letters Patent of the United States is:

1. A headlamp for an automobile, capable of emitting a beam of light with a cut-off, said headlamp comprising: a part-ellipsoidal reflector having a substantially horizontal optical axis, a first focus on said axis relatively close to said reflector and a second focus on the axis relatively distant from said reflector; a light source located in the vicinity of said first focus of said reflector; a convergent lens arranged opposite said reflector with respect to said second focus of said reflector, said lens being arranged in a substantially vertical plane and having a substantially horizontal optical axis in common with that of said reflector and a focus in the vicinity of said second focus of said reflector; a substantially vertical masking screen with a generally horizontal cut-off edge arranged in the vicinity of said focus of said lens and having its said cut-off edge close to the common optical axis in order to define a substantially horizontally cut-off beam, and spaced apart localized deflector elements in the vicinity of said lens at its upper part and at its lower part to produce a deflection of the light passing through said upper and lower parts of said lens in order to reduce the effects of chromatic aberrations in the vicinity of said cut-off, each of said deflector elements being substantially contiguous with the adjacent edge of the lens at its outer edge and having a substantially horizontal inner edge, said inner edges defining a deflector free lens area therebetween.

2. A headlamp according to claim 1 wherein said deflection of said light passing through said upper and lower parts of said lens constitutes a lateral dispersion of said light.

3. A headlamp according to claim 1 wherein said deflection of said light passing through said upper and lower parts of said lens constitutes a lowering of said light.

4. A headlamp according to claim 1 wherein said deflector elements are directly attached to said lens.

5. A headlamp according to claim 1 further including a transparent glass and wherein said deflector elements are attached to said transparent glass, said transparent glass being juxtaposed to the lens.

6. A headlamp according to claim 1 wherein said upper and lower parts of said lens associated with said deflector elements are limited to bands which are contiguous respectively with an upper edge and a lower edge of said lens, the height of each of said bands being between 1/10 and ¼ of the height of said lens.

7. A headlamp according to claim 2 wherein said upper and lower parts of said lens associated with said deflector elements are limited to bands which are contiguous respectively with an upper edge and a lower edge of said lens, the height of each of said bands being between 1/10 and ¼ of the height of said lens.

8. A headlamp according to claim 3 wherein said upper and lower parts of said lens associated with said deflector elements are limited to bands which are contiguous respectively with an upper edge and a lower edge of said lens, the height of each of said bands being between 1/10 and ¼ of the height of said lens.

9. A headlamp according to claim 4 wherein said upper and lower parts of said lens associated with said deflector elements are limited to bands which are contiguous respectively with an upper edge and a lower edge of said lens, the height of each of said bands being between 1/10 and $\frac{1}{4}$ of the height of said lens.

10. A headlamp according to claim 5 wherein said upper and lower parts of said lens associated with said deflector elements are limited to bands which are contiguous respectively with an upper edge and a lower edge of said lens, the height of each of said bands being between 1/10 and $\frac{1}{4}$ of the height of said lens.

* * * * *